US010755834B2

(12) United States Patent
Kaga et al.

(10) Patent No.: US 10,755,834 B2
(45) Date of Patent: Aug. 25, 2020

(54) INSULATED WIRE

(71) Applicant: Hitachi Metals, Ltd., Minato-ku, Tokyo (JP)

(72) Inventors: Masafumi Kaga, Tokyo (JP); Tamotsu Kibe, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/156,720

(22) Filed: Oct. 10, 2018

(65) Prior Publication Data

US 2019/0139674 A1 May 9, 2019

(30) Foreign Application Priority Data

Nov. 7, 2017 (JP) ..... 2017-214345

(51) Int. Cl.
*H01B 7/02* (2006.01)
*H01B 3/44* (2006.01)
*H01B 7/295* (2006.01)

(52) U.S. Cl.
CPC ..... *H01B 7/0225* (2013.01); *H01B 3/441* (2013.01); *H01B 3/447* (2013.01); *H01B 3/448* (2013.01); *H01B 7/295* (2013.01)

(58) Field of Classification Search
CPC ..... H01B 3/441; H01B 3/448; H01B 7/292; H01B 7/295; H01B 3/447
USPC ..... 174/110 R, 11 SR, 120 R, 120 SR
See application file for complete search history.

(56) References Cited

U.S. PATENT DOCUMENTS 3,663,742 A * 5/1972 Hasebe ..... H01B 3/308 174/120 SC
4,353,817 A * 10/1982 Nakae ..... C08K 3/22 524/232
5,358,786 A * 10/1994 Ishikawa ..... H01B 3/30 174/110 AR
6,359,230 B1 * 3/2002 Hildreth ..... H01B 3/441 174/110 R (Continued)

FOREIGN PATENT DOCUMENTS

JP 5-47225 A 2/1993
JP 6-52728 A 2/1994

(Continued)

OTHER PUBLICATIONS

English translation of document C2 (Japanese-language Office Action issued in counterpart Japanese Application No. 2017-214345) dated Feb. 1, 2019 (four pages).
Japanese-language Office Action issued in counterpart Japanese Application No. 2017-214345 dated Nov. 22, 2018 (three pages).
Japanese-language Office Action issued in counterpart Japanese Application No. 2017-214345 dated Feb. 1, 2019 (two pages).
"Common Test Methods for Cables Under Fire Conditions-Test for Vertical Flame Spread of Vertically-Mounted Bunched Wires or Cables," British Standard, EN 50266-2-4:2001 (14 pages).

(Continued)

*Primary Examiner* — William H. Mayo, III
(74) *Attorney, Agent, or Firm* — Crowell & Moring LLP

(57) ABSTRACT

An insulated wire, having an electrical wire structure capable of reducing an outer diameter while maintaining an insulating property and a flame-retardant property, includes a conductor and a coating layer arranged on an outer periphery of the conductor. The coating layer includes a plurality of flame-retardant layers, each made of a flame-retardant resin composition, and an insulating layer interposed between the plurality of flame-retardant layers. A ratio of a thickness of the insulating layer to a thickness of the coating layer is equal to or larger than 10% and equal to or smaller than 35%.

12 Claims, 2 Drawing Sheets

(56) References Cited

U.S. PATENT DOCUMENTS

| | | | | |
|---|---|---|---|---|
| 8,946,557 | B2 * | 2/2015 | Fukuda | H01B 3/301 174/110 AR |
| 9,443,645 | B2 | 9/2016 | Iwasaki et al. | |
| 2006/0173089 | A1 * | 8/2006 | Jackson | C08L 23/06 522/109 |
| 2008/0311328 | A1 * | 12/2008 | Kimura | C08K 9/06 428/36.91 |
| 2013/0228358 | A1 * | 9/2013 | Fujimoto | H01B 7/292 174/110 SR |
| 2014/0011028 | A1 | 1/2014 | Iwasaki et al. | |
| 2014/0030520 | A1 * | 1/2014 | Nakamura | H01B 3/308 428/368 |
| 2014/0083738 | A1 * | 3/2014 | Segawa | H01B 7/295 174/120 C |
| 2014/0182883 | A1 * | 7/2014 | Sugita | H01B 3/447 174/113 R |
| 2014/0367144 | A1 * | 12/2014 | Segawa | H01B 3/441 174/113 R |
| 2014/0370315 | A1 * | 12/2014 | Iwasaki | H01B 3/441 428/516 |
| 2015/0034359 | A1 * | 2/2015 | Sugita | H01B 7/295 174/107 |
| 2015/0371735 | A1 * | 12/2015 | Iwasaki | H01B 7/29 428/372 |
| 2016/0125973 | A1 * | 5/2016 | Iwasaki | H01B 3/448 428/383 |
| 2017/0032867 | A1 * | 2/2017 | Iwasaki | H01B 3/447 |
| 2017/0365378 | A1 * | 12/2017 | Kaga | C08L 23/0853 |

FOREIGN PATENT DOCUMENTS

| | | | | |
|---|---|---|---|---|
| JP | 2011-228189 | A | 11/2011 | |
| JP | 2014-11140 | A | 1/2014 | |
| JP | 2014-225478 | A | 12/2014 | |
| JP | 2015-118857 | A * | 6/2015 | H01B 7/295 |
| JP | 2015-118857 | A | 6/2015 | |
| JP | 2017-27878 | A | 2/2017 | |

OTHER PUBLICATIONS

"Railway Applications—Railway Rolling Stock Cables Having Special Fire Performance-Test Methods," British Standard, EN 50305:2002 (42 pages).

"Testing Methods of Plastic Films for Electrical Purposes" JIS C2151, Aug. 20, 2006, Japanese Standards Association, with partial English translation (57 pages).

"Plastics-Determination of Burning Behavior by Oxygen Index—Part 2: Ambient-Temperature Test," JIS K7201-2, Mar. 20, 2007, Japanese Standards Association, with partial English translation (40 pages).

Japanese-language Office Action issued in Japanese Application No. 2019-5195 dated Mar. 26, 2020 with English translation (nine (9) pages).

* cited by examiner

INSULATED WIRE

CROSS-REFERENCE TO RELATED APPLICATION

The present application claims priority from Japanese Patent Application No. 2017-214345 filed on Nov. 7, 2017, the content of which is hereby incorporated by reference into this application.

TECHNICAL FIELD OF THE INVENTION

The present invention relates to an insulated wire.

BACKGROUND OF THE INVENTION

Insulated wires, which are used as wiring in railroad cars and automobiles, are required to have not only the insulation property but also such a flame-retardant property as making the wires difficult to burn at the time of fire. For this reason, a flame retardant is contained in a coating layer of the insulated wire. For example, Japanese Patent Application Laid-Open Publication No. 2014-11140 (Patent Document 1) discloses an insulated wire having a coating layer formed by stacking a flame-retardant layer containing a flame retardant on an outer periphery of an insulating layer having an insulation property. According to the Patent Document 1, the insulation property and the flame-retardant property can be well balanced at a high level.

SUMMARY OF THE INVENTION

Meanwhile, in recent years, reducing an outer diameter of the insulated wire has been required for a purpose of reducing a weight of the insulated wire. Therefore, reducing thicknesses of an inner-positioned insulating layer and an outer-positioned flame-retardant layer has been studied.

Accordingly, an object of the present invention is to provide an insulated wire having a wire structure in which the outer diameter of the wire can be reduced while the insulation property and the flame-retardant property are kept high.

The present invention provides the following insulated wires.

[1] The insulated wire includes: a conductor; and a coating layer arranged on an outer periphery of the conductor. In the insulated wire, the coating layer includes: a plurality of flame-retardant layers each made of a flame-retardant resin composition; and an insulating layer interposed between the plurality of flame-retardant layers, and a ratio of a thickness of the insulating layer to a thickness of the coating layer is equal to or larger than 10% and equal to or smaller than 35%.

[2] In the insulated wire described in the aspect [1], the insulated wire has a flame-retardant property that allows the insulated wire to pass a vertical tray flame test (VTFT) on the basis of EN 50266-2-4.

[3] In the insulated wire described in the aspect [1] or [2], the insulated wire has a direct-current stability that allows the insulated wire to pass a direct-current stability test in conformity to EN 50305.6.7.

[4] In the insulated wire described in any one of aspects [1] to [3], a diameter of the conductor is equal to or smaller than 1.25 mm, and a thickness of the coating layer is smaller than 0.6 mm.

[5] In the insulated wire described in any one of aspects [1] to [4], breaking elongation of the coating layer measured in a tensile test with a tension rate of 200 m/min is equal to or larger than 150%.

[6] In the insulated wire described in any one of aspects [1] to [5], an oxygen index of the flame-retardant layer defined by JIS K7201-2 is higher than 45.

[7] In the insulated wire described in any one of aspects [1] to [6], a volume resistivity of the insulating layer defined by JIS C2151 is higher than $5.0\times10^{15}$ (Ωcm).

[8] In the insulated wire described in any one of aspects [1] to [7], a flame-retardant resin composition making up the flame-retardant layer includes at least one resin selected from a group consisting of high-density polyethylene, linear low-density polyethylene, low-density polyethylene, ethylene-(α-olefin) copolymer, ethylene-vinyl acetate copolymer, ethylene-acrylic acid ester copolymer, and ethylene-propylene-diene copolymer.

[9] In the insulated wire described in any one of aspects [1] to [8], a flame-retardant resin composition making up the flame-retardant layer contains a resin component and a flame retardant so that 150 or more and 250 or less parts by mass of the flame retardant per 100 parts by mass of the resin component is contained.

[10] In the insulated wire described in any one of aspects [1] to [9], a resin composition making up the insulating layer contains a resin component so that the resin component is made of high-density polyethylene and/or low-density polyethylene.

According to the present invention, an insulated wire having a wire structure in which the outer diameter of the wire is reduced while the insulation property and the flame-retardant property are kept high can be provided.

BRIEF DESCRIPTIONS OF THE DRAWINGS

DESCRIPTIONS OF THE PREFERRED EMBODIMENTS

Figure 3:
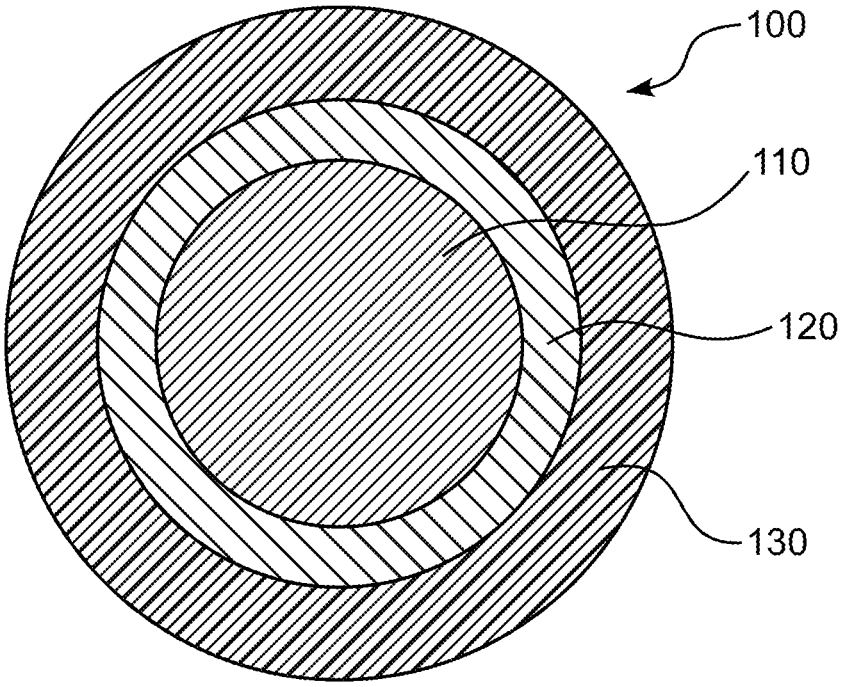
FIG. 3 is a horizontal cross-sectional view showing a related-art insulated wire.

First, the related-art insulated wire will be described with reference to FIG. 3. FIG. 3 is a cross-sectional view of the related-art insulated wire that is vertical to a longitudinal direction.

As shown in FIG. 3, a related-art insulated wire 100 includes a conductor 110, an insulating layer 120 arranged on an outer periphery of the conductor 110, and a flame-retardant layer 130 which is arranged on an outer periphery of the insulating layer 120 and mixed with a flame retardant.

In the related-art insulated wire 100, the flame-retardant layer 130 is made of a resin as similar to the insulating layer 120, and therefore, exhibits a predetermined insulation property.

However, insulation reliability is low, and therefore, the insulation property does not contribute to direct-current stability in many cases. As described later, the direct-current stability is one of electrical characteristics evaluated by a direct-current stability test in conformity to the test standard EN 50305.6.7. The direct-current stability shows that a breakdown does not occur in the insulated wire even after an elapse of a predetermined time in immersion of the insulated wire 100 into salt solution with application of a predetermined voltage, and becomes an index of the insulation reliability.

According to the study made by the present inventors, it has been found out that the reason why the flame-retardant layer 130 does not contribute to the direct-current stability is that a volume resistivity is low because of the mixture of the flame retardant. As one of causes for this, in the flame-retardant layer 130, it is considered that small gaps are undesirably formed around the flame retardant because of low adherence between the resin and the flame retardant which make up the flame-retardant layer 130. Because of these gaps, moisture easily infiltrates and is absorbed into the flame-retardant layer 130. In such a flame-retardant layer 130, when the insulated wire 100 is immersed into water to evaluate its direct-current stability, a conductive path is formed because of the infiltration of the moisture to easily cause the breakdown, and therefore, there is the tendency of the low insulation reliability. In this manner, the flame-retardant layer 130 tends to have the low insulation property because of the water absorption, and consequently does not contribute to the direct-current stability.

On the other hand, the insulating layer 120 is coated with the flame-retardant layer 130, and therefore, does not need to be mixed with a flame retardant. For this reason, although the insulating layer 120 does not exhibit the flame-retardant property as observed in the flame-retardant layer 130, the insulating layer 120 is configured so as to have a high volume resistivity, and therefore, contributes to the direct-current stability.

In this manner, in the related-art insulated wire 100, the insulating layer 120 contributes to the direct-current stability while the flame-retardant layer 130 contributes to the flame-retardant property. Therefore, in order to achieve both the direct-current stability and the flame-retardant property at high levels, it is required to thicken each of the insulating layer 120 and the flame-retardant layer 130, and therefore, it is difficult to thin each of them in the purpose of reducing the diameter of the insulated wire 100.

Considering the fact that the related-art insulated wire 100 tends to absorb the moisture and has the low direct-current stability (insulation reliability) because of the formation of the flame-retardant layer 130 having the low volume resistivity on a surface, the present inventors have thought up that the flame-retardant layer 130 can contribute to not only the flame-retardant property but also the direct-current stability by configuring the flame-retardant layer 130 so that the moisture is not infiltrated therein, which consequently results in achievement of the thinning of the insulating layer 120 to allow the diameter of the insulated wire 100 to be reduced.

Accordingly, as a result of study on a method for suppressing the water infiltration into the flame-retardant layer 130, the present inventors have thought up that the insulating layer is formed on an outer periphery of the flame-retardant layer.

That is, since the water infiltration into the flame-retardant layer can be suppressed by the insulating layer, the flame-retardant layer can function as a resin layer having not only the flame-retardant property but also the direct-current stability. In this manner, the insulating layer 120 which is conventionally formed can be removed. That is, a stacked structure formed of the related-art insulating layer 120 and flame-retardant layer 130 can be formed as a stacked structure of a flame-retardant layer and an insulating layer. The insulating layer has such a thickness as preventing the water infiltration, and does not need to be thickly formed as in the related-art insulating layer 120, and therefore, the outer diameter of the insulated wire can be reduced.

However, the insulating layer practically contains no flame retardant, and therefore, is poor in the flame-retardant property. Therefore, when such an insulating layer is formed on the surface of the insulated wire, there is a risk of reduction in the flame-retardant property of the entire insulated wire.

Regarding this, the flame-retardant property is kept in the second flame-retardant layer by forming the insulating layer with the poor flame-retardant property between flame-retardant layers to form, for example, a coating layer made of three layers that are a first flame-retardant layer, the insulating layer, and a second flame-retardant layer (which may hereinafter be collectively referred to as "coating layer") in this order from the conductor side, and besides, the direct-current stability is kept high by suppressing the water infiltration into the first flame-retardant layer by using the insulating layer, and the diameter can be reduced. When a plurality of such insulated wires whose diameters can be reduced are bundled together and used as a wire harness, such a further effect as a reduction in the weight of the wire harness is caused.

In order to achieve both the flame-retardant property and the insulation property, the present inventors have further paid attention to a ratio of the thickness of the insulating layer to the thickness of the coating layer, and has found out that both the flame-retardant property and the insulation property can be achieved when the ratio of the thickness of the insulating layer to the thickness of the coating layer is 10% or higher and 35% or lower.

In addition, by forming the first and second flame-retardant layers such that they each have an oxygen index that is an index of the flame-retardant property and is higher than 45, the higher flame-retardant property of the coating layer can be kept with the first and second flame-retardant layers being further thinned.

In the present specification, note that "the reduction in the diameter" means that the outer diameter of the insulated wire is reduced by thinning the coating layer of the insulated wire so as to be thinner than that of the related-art insulated wire (Table 1—General data—Cable type 0.6/1 kV unsheathed of EN 50264-3-1 (2008)) having the same conductor diameter.

Specifically, when the conductor diameter is equal to or smaller than 1.25 mm, the thickness of the coasting layer of the insulated wire can be smaller than 0.60 mm. When the conductor diameter is larger than 1.25 mm and equal to or smaller than 5.00 mm, the thickness of the coasting layer of the insulated wire can be smaller than 0.70 mm. When the conductor diameter is larger than 5.00 mm and equal to or smaller than 7.70 mm, the thickness of the coasting layer of the insulated wire can be smaller than 0.90 mm. When the conductor diameter is larger than 7.7 mm and equal to or smaller than 9.20 mm, the thickness of the coasting layer of the insulated wire can be smaller than 1.00 mm. When the conductor diameter is larger than 9.20 mm and equal to or smaller than 12.50 mm, the thickness of the coasting layer of the insulated wire can be smaller than 1.10 mm. When the conductor diameter is larger than 12.50 mm and equal to or smaller than 14.20 mm, the thickness of the coasting layer of the insulated wire can be smaller than 1.20 mm. When the conductor diameter is larger than 14.20 mm and equal to or smaller than 15.80 mm, the thickness of the coasting layer of the insulated wire can be smaller than 1.40 mm. When the conductor diameter is larger than 15.80 mm and equal to or smaller than 17.50 mm, the thickness of the coasting layer of the insulated wire can be smaller than 1.60 mm. When the conductor diameter is larger than 17.50 mm and equal to or smaller than 20.10 mm, the thickness of the coasting layer of the insulated wire can be smaller than 1.70 mm. When the conductor diameter is larger than 20.10 mm and equal to or smaller than 22.50 mm, the thickness of the coasting layer of the insulated wire can be smaller than 1.80 mm. When the conductor diameter is larger than 22.50 mm and equal to or smaller than 25.80 mm, the thickness of the coasting layer of the insulated wire can be smaller than 2.00 mm.

In addition, a mechanical strength has been evaluated on the basis of the standard EN 50264, 60811-1-2, and the breaking elongation can be equal to or higher than 150%.

The present invention has been made on the basis of the above-described findings.

<Configuration of Insulated Wire>

Figure 1:
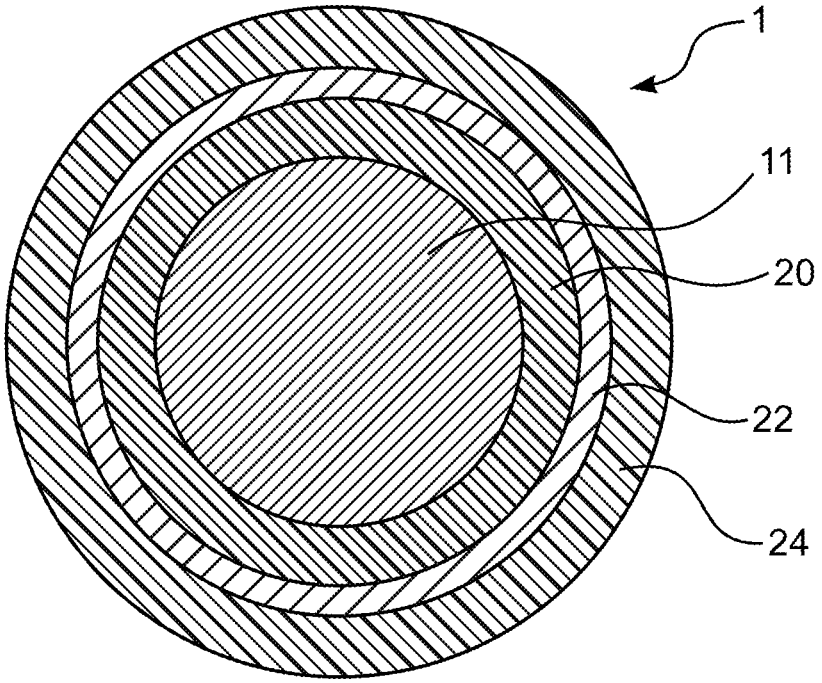
FIG. 1 is a horizontal cross-sectional view showing an embodiment of an insulated wire of the present invention.

Hereinafter, an insulated wire according to an embodiment of the present invention will be described with reference to drawings. FIG. 1 is a cross-sectional view that is vertical to a longitudinal direction of the insulated wire according to the embodiment of the present invention. As shown in FIG. 1, the insulated wire 1 according to the present embodiment includes a conductor 11, a first flame-retardant layer 20, an insulating layer 22, and a second flame-retardant layer 24.

According to the present embodiment, the insulating layer 22 is arranged on an outer periphery of the first flame-retardant layer 20, and the second flame-retardant layer 24 is arranged on an outer periphery of the insulating layer. In other words, the coating layer is formed by stacking three layers that are the first flame-retardant layer 20, the insulating layer 22, and the second flame-retardant layer 24 in this order from the conductor 11 side.

(Conductor)

As the conductor 11, not only a normally-used metal wire such as a copper wire or a copper alloy wire but also an aluminum wire, a gold wire, and a silver wire can be used. A metal wire whose outer periphery is metal-plated with tin, nickel or others may be used. Further, a bunch stranded conductor formed by strand metal wires can be also used. A cross-sectional area and an outer diameter of the conductor 11 can be properly changed in accordance with the electrical characteristics required for the insulated wire 1. For example, the cross-sectional area is exemplified to be equal to or larger than 1 $mm^2$ and equal to or smaller than 10 $mm^2$, and the outer diameter is exemplified to be equal to or larger than 1.20 mm and equal to or smaller than 2.30 mm.

(First Flame-Retardant Layer)

It is preferred that the first flame-retardant layer 20 is formed by, for example, extruding a flame-retardant resin composition to the outer periphery of the conductor 11 so that the oxygen index is higher than 45. In the present embodiment, the first flame-retardant layer 20 is formed so that the oxygen index is higher than 45, and thus, contributes to the flame-retardant property of the coating layer. In addition, since the first flame-retardant layer 20 is covered with the insulating layer 22, the water infiltration into the first flame-retardant layer 20 is suppressed when the insulated wire 1 is immersed into water to evaluate its direct-current stability, and therefore, the first flame-retardant layer 20 has the high insulation reliability, and also contributes to the direct-current stability of the coating layer. That is, the first flame-retardant layer 20 contributes to not only the flame-retardant property but also to the direct-current stability, and functions as a flame-retardant insulating layer.

The first flame-retardant layer 20 is not limited in the oxygen index, but preferably has the oxygen index higher than 45 from the viewpoint of the flame-retardant property. Note that the oxygen index is an index of the flame-retardant property, and is defined by the standard JIS K7201-2 in the present embodiment.

The flame-retardant resin composition making up the first flame-retardant layer 20 contains a resin component and a flame retardant when necessary. It is preferable that such a flame-retardant resin composition be a non-halogen flame-retardant resin composition.

A type of the resin component making up the first flame-retardant layer 20 may be properly changed in accordance with characteristics required for the insulated wire 1, such as breaking elongation and strength. For example, polyolefin, polyimide, polyether ether ketone (PEEK), etc., can be used. When a resin with a high flame-retardant property is used, addition of the flame retardant is optional. When the polyolefin is used, it is preferable to mix a large amount of the flame retardant in order to increase the oxygen index of the first flame-retardant layer 20. When the polyimide or the PEEK is used, each material has a high flame-retardant property of the resin itself, and therefore, it is not required to mix the flame retardant. In comparison with the polyimide, etc., the polyolefin has a lower forming temperature, and therefore, has better formability, and besides, has larger breaking elongation to cause better bendability of the first flame-retardant layer 20.

As the polyolefin, a polyethylene-based resin, polypropylene-based resin, etc., can be used, and the polyethylene-based resin is particularly preferable. As the polyethylene-based resin, for example, linear low-density polyethylene (LLDPE), low-density polyethylene (LDPE), high-density polyethylene (HDPE), ethylene-(α-olefin) copolymer, ethylene-vinyl acetate copolymer (EVA), ethylene-acrylic acid ester copolymer, ethylene-propylene-diene copolymer, etc., can be used. Out of these resins, one type may be singularly used, or two or more types may be used in combination. From the viewpoint of obtaining the higher flame-retardant property of the first flame-retardant layer 20, EVA of these polyolefin-based resins is particularly preferable.

As the flame retardant, a non-halogen flame retardant is preferable because it does not generate a toxic gas, and, for example, a metallic hydroxide can be used. The metallic hydroxide decomposes and dehydrates when the first flame-retardant layer 20 is heated to burn, and reduces a temperature of the first flame-retardant layer 20 because of released moisture, and suppresses the burning. As the metallic hydroxide, for example, magnesium hydroxide, aluminum hydroxide, calcium hydroxide, and metallic hydroxide obtained by dissolving nickel in solution of such a material can be used. Out of these flame retardant materials, one type may be singularly used, or two or more types may be used in combination.

From the viewpoint of controlling the mechanical characteristics (balance between the tensile strength and the breaking elongation) of the first flame-retardant layer 20, a surface of the flame retardant is preferably treated with a silane coupling agent, titanate-based coupling agent, fatty acid such as stearic acid, fatty acid salt such as stearate, or fatty acid metal salt such as calcium stearate.

From the viewpoint of setting the oxygen index of the first flame-retardant layer 20 to be higher than 45, a mixture amount of the flame retardant is preferable to be equal to or larger than 150 parts by mass and equal to or smaller than 250 parts by mass per 100 parts by mass of the resin component. When the mixture amount is smaller than 150 parts by mass, there is a risk of failing to obtain the desired high flame-retardant property in the insulated wire 1. When the mixture amount is larger than 250 parts by mass, there is a risk of reduction in the mechanical characteristics of the first flame-retardant layer 20, which results in the reduction in the breaking elongation.

When necessary, additives such as other flame retardant, flame retardant promoter, cross-linking agent, cross-linking promoter, plasticizer, metal chelator, softener, reinforcing agent, surfactant, stabilizer, ultraviolet absorber, light stabilizer, lubricant, antioxidant, colorant, processing modifier, inorganic filler, compatibilizer, foaming agent, and antistatic agent may be added to the resin component making up the first flame-retardant layer 20.

A thickness of the first flame-retardant layer 20 is exemplified to be equal to or larger than 0.03 mm and equal to or smaller than 0.3 mm although not particularly limited to a specific value.

Note that the first flame-retardant layer 20 may be cross-linked. For example, it may be cross-linked by radiation such as electron beam. Alternatively, it may be cross-linked after a cross-linking promoter is added to the flame-retardant resin composition making up the first flame-retardant layer 20, and then, the flame-retardant resin composition is extrusion-molded.

(Insulating Layer)

The insulating layer 22 is preferably made of an insulating resin composition whose volume resistivity is higher than $5.0\times10^{15}$ (Ωcm) to be configured so that a water absorption amount and a water diffusion coefficient are small. The insulating layer 22 has a high water impervious property, and hardly allows water to infiltrate therein, and therefore, the water infiltration into the first flame-retardant layer 20 located inside the coating layer can be suppressed. Although the insulating layer 22 practically contains no flame retardant and has therefore a low flame-retardant property, the insulating layer 22 is covered with the second flame-retardant layer 24 described later.

A material making up the insulating layer 22 is preferably a material whose volume resistivity is higher than $5.0\times10^{15}$ (Ωcm), and there is no particular upper limit in the volume resistivity. When the volume resistivity is lower than $5.0\times10^{15}$ (Ωcm), the insulation resistance is reduced at the time of water absorption in the insulting layer 22, and therefore, the direct-current stability is reduced. In this specification, note that the volume resistivity is evaluated in conformity to the JIS C2151.

From the viewpoint of ensuring the forming workability of the insulating layer 22, a resin is preferable as a material making up the insulating layer 22, and the same resin as that of the first flame-retardant layer 20 can be used. Polyolefin is more preferable for the insulating layer 22, and high-density polyethylene and/or low-density polyethylene can be used. Among these materials, linear low-density polyethylene (LLDPE) is particularly preferable because of a low moisture absorption rate, favorable formability, relatively large breaking elongation, other excellent properties such as high oil resistance (solvent resistance), and inexpensiveness.

When the insulating layer 22 is made of such a resin as LLDPE, for example, an insulating resin composition containing LLDPE is formed by its extrusion molding to the outer periphery of the first flame-retardant layer 20. From the viewpoint of further improving the water impervious property of the insulating layer 22, it is preferable to form the insulating layer 22 from a cross-linked substance by mixture and cross-linkage of a cross-linking agent, a cross-linking promoter, etc., to/with the insulating resin composition. Because of the cross-linkage, a molecular structure of the resin composition becomes rigid, so that the water impervious property of the insulating layer 22 can be improved. Besides, the strength of the insulating layer 22 can be also improved. Therefore, even if the insulating layer 22 is thinned, the high water impervious property can be kept without losing the strength. The insulating layer 22 is preferably a non-halogen resin composition.

It is preferable to form the cross-linked substance making up the insulating layer 22 so that its gel fraction is equal to or larger than 40% and equal to or smaller than 100%. The strength and the water impervious property of the insulating layer 22 can be increased by increase in the gel fraction of the cross-linked substance, and therefore, the insulating layer 22 can be thinned.

For the case of the cross-linkage of the insulating layer 22, it is better to mix a known cross-linking agent or cross-linking promoter to the insulating resin composition. As the cross-linking agent, for example, organic peroxide, a silane coupling agent, etc., can be used. As the cross-linking promoter, for example, a polyfunctional monomer such as triallyl isocyanurate and trimethylol propane triacrylate can be used. Such a material is not limited in a mixture amount. For example, the mixture amount may be changed properly so that a degree of the cross-linkage of the cross-linked substance making up the insulating layer 22 in terms of the gel fraction is equal to or larger than 40% and equal to or smaller than 100%. As a method for the cross-linkage, a publicly-known method such as chemical cross-linkage and electron beam cross-linkage can be adopted in accordance with a type of the cross-linking agent.

The insulating layer 22 can contain an additive of equal to or smaller than 5 parts by mass per 100 parts by mass of the resin component. The insulating layer 22 contains preferably the additive being equal to or smaller than 3 parts by mass, and more preferably the additive being equal to or smaller than 1.5 parts by mass.

Here, the additive means an additive such as cross-linking agent, cross-linking promoter, copper inhibitor, flame retardant, flame retardant promoter, plasticizer, filler, metal chelator, softener, reinforcing agent, surfactant, stabilizer, ultraviolet absorber, light stabilizer, lubricant, antioxidant, colorant (e.g., carbon black), processing modifier, inorganic filler, compatibilizer, foaming agent, and antistatic agent.

(Second Flame-Retardant Layer)

The second flame-retardant layer 24 is formed by, for example, extrusion of a flame-retardant resin composition containing a flame retardant to the outer periphery of the insulating layer 22 so that the oxygen index is higher than 45 as similar to the first flame-retardant layer 20. The second flame-retardant layer 24 is positioned on the surface layer of the coating layer and is not covered with the insulating layer 22 as different from the first flame-retardant layer 20, and therefore, the second flame-retardant layer 24 allows the water to easily infiltrate therein and does not contribute to the direct-current stability. However, the second flame-retardant layer 24 covers the insulating layer 22 having the low flame-retardant property to suppress the reduction in the flame-retardant property of the entire coating layer. It is preferable to form the second flame-retardant layer 24 from a non-halogen flame-retardant resin composition.

Note that he same flame-retardant resin composition as that making up the first flame-retardant layer 20 can be used as the flame-retardant resin composition making up the second flame-retardant layer 24. The second flame-retardant layer 24 may be cross-linked as similar to the first flame-retardant layer 20. The second flame-retardant layer 24 may be cross-linked by, for example, performing a cross-linking treatment after mixture of a cross-linking agent or a cross-linking promoter with the resin composition making up the second flame-retardant layer 24, and extrusion. A cross-linking method is not limited to any particular method. A related-art publicly-known cross-linking method such as irradiation with electron beam may be adopted.

(Stacked Structure of Coating Layer)

Subsequently, a stacked structure of the coating layer (formed of the first flame-retardant layer, the insulating layer, and the second flame-retardant layer) will be described. A ratio of the thickness of the insulating layer to the thickness of the coating layer is equal to or larger than 10% and equal to or smaller than 35%. This is because the direct-current stability is reduced when the ratio of the thickness of the insulating layer to the thickness of the coating layer is smaller than 10%, and because the flame-retardant property is reduced when the ratio of the thickness of the insulating layer to the thickness of the coating layer is larger than 35%.

The following is examples of each thickness of the first flame-retardant layer, the insulating layer, and the second flame-retardant layer on the basis of the conductor diameter. When the conductor diameter is 1.00 mm to 1.50 mm, the thickness of the insulating layer is desirably equal to or larger than 0.05 mm and equal to or smaller than 0.21, the thickness of the first flame-retardant layer is preferably equal to or larger than 0.10 mm, and the thickness of the second flame-retardant layer is preferably equal to or larger than 0.22 mm.

When the conductor diameter is 9.2 mm to 11.00 mm, the thickness of the insulating layer is preferably equal to or larger than 0.08 mm and equal to or smaller than 0.28, the thickness of the first flame-retardant layer is preferably equal to or larger than 0.10 mm, and the thickness of the second flame-retardant layer is preferably equal to or larger than 0.42 mm.

When the conductor diameter is 22.5 mm to 25.8 mm, the thickness of the insulating layer is preferably equal to or larger than 0.15 mm and equal to or smaller than 0.52, the thickness of the first flame-retardant layer is preferably equal to or larger than 0.10 mm, and the thickness of the second flame-retardant layer is preferably equal to or larger than 0.80 mm.

The coating layer shown in FIG. 1 according to the embodiment of the present invention is formed of three layers. Meanwhile, the three layers may have a multi-layered structure in which a plurality of the first flame-retardant layers 20 may be formed on an outer periphery of the conductor 11, a plurality of the insulating layers 22 may be formed on an outer periphery of the first flame-retardant layer 20, and a plurality of the second flame-retardant layers 24 may be formed on an outer periphery of the insulating layer 22.

It is only required to form the first flame-retardant layer on the outer periphery of the conductor 11, the second flame-retardant layer 24 as the outermost layer, and the insulating layer 22 between these two layers. There is no problem of existence of a different resin composition layer between the first flame-retardant layer 20 and the insulating layer 22 and between the insulating layer 22 and the second flame-retardant layer 24.

Figure 2:
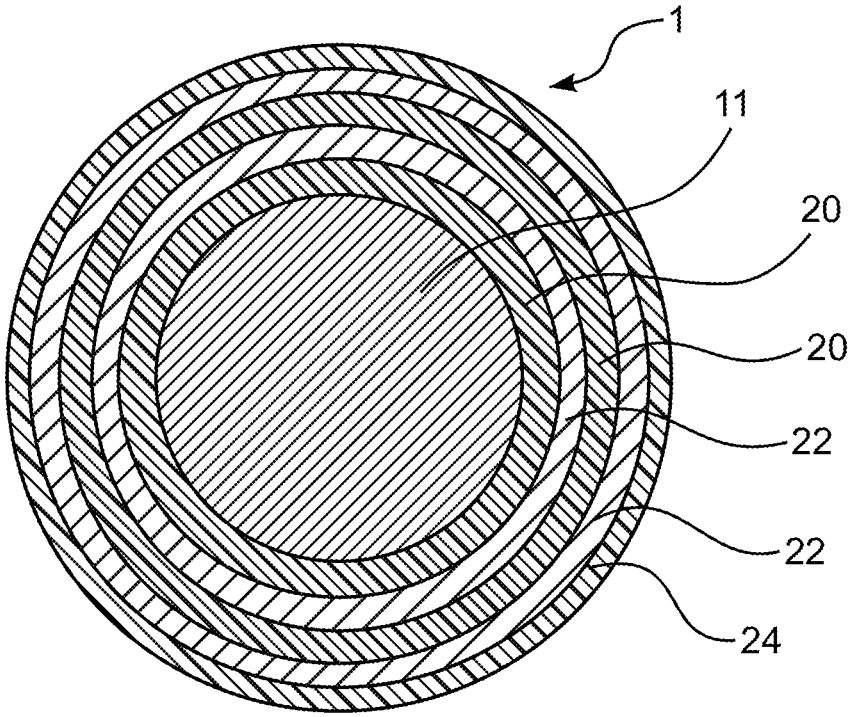
FIG. 2 is a horizontal cross-sectional view showing another embodiment of an insulated wire of the present invention.

As shown in FIG. 2, a plurality of the first flame-retardant layers 20 and a plurality of insulating layers 22 may be provided so as to form a five-layer structure in which the insulating layers 22 are interposed among three flame-retardant layers (the first flame-retardant layer 20, the first flame-retardant layer 20, and the second flame-retardant layer 24).

When there is a different insulating layer other than the first flame-retardant layer 20, the insulating layer 22, and the second flame-retardant layer 24, "the thickness of the coating layer" described here means the thickness of the entire coating layer also including the different insulating layer.

Note that the insulated wire of the present embodiment is not particularly limited in its application. However, the insulated wire can be used as, for example, a power system wire (an insulated wire in conformity to Power & Control Cables described in EN 50264-3-1 (2008)).

Practical Examples

Next, the present invention will be further described in detail on the basis of practical examples. However, the present invention is not limited by these practical examples.

<Materials Used in Practical Examples and Comparative Examples>

Ethylene-vinyl acetate (EVA) copolymer: "EvaFlex EV170" produced by Du Pont-Mitsui Polychemicals Co., Ltd.

Maleic acid modified polymer: "TAFMAR MH7020" produced by Mitsui Chemicals, Inc.

Thermoplastic polyimide: "AURUM PL450C" produced by Mitsui Chemicals, Inc.

Silicone modified polyetherimide: "STM1500" produced by SABIC Corporation

Linear low-density polyethylene (LLDPE): "EVOLUE SP2030" produced by Prime Polymer Co., Ltd.

Flame retardant (magnesium hydroxide): "KISUMA 5A" produced by Kyowa Chemical Industry Co., Ltd.

Mixed-system antioxidant: "Adekastab AO-18" produced by ADEKA Corporation

Phenolic-system antioxidant: "Irganox1010" produced by BASF SE Corporation

Carbon black: "ASAHI THERMAL" produced by Asahi Carbon Co., Ltd.

Lubricant (zinc stearate)

Cross-linking promoter (trimethylol propane triacrylate (TMPT)): produced by Shin Nakamura Chemical Co., Ltd.

<Preparation of Flame-Retardant Resin Composition>

75 parts by mass of the EVA, 25 parts by mass of the maleic acid modified polymer, 150 parts by mass of the magnesium hydroxide, 2 parts by mass of the cross-linking promoter, 2 parts by mass of the mixed-system antioxidant, 2 parts by mass of the carbon black, and 1 parts by mass of the lubricant were mixed together, and the mixture was kneaded by using a 75-L pressure kneader. After the kneading, the kneaded mixture was extruded by using an extruder to form a strand, and was cooled in water and then cut, so that a pellet flame-retardant resin composition was obtained. This pellet had a cylindrical shape having a diameter of about 3 mm and a height of about 5 mm. Note that the oxygen index was 45.5.

<Preparation of Insulating Resin Composition>

To prepare the insulating resin composition for making up the insulating layer 22, 100 parts by mass of the LLDPE and 1 parts by mass of the phenolic-system antioxidant were dry-blended and kneaded together by using a pressure kneader, so that the insulating resin composition was prepared.

<Production of Insulated Wire>

First Practical Example

The insulated wire 1 was produced by using the above-described flame-retardant resin composition and insulating resin composition. Specifically, the insulated wire 1 of a first practical example was produced by three-layer co-extrusion of the flame-retardant resin composition, the insulating resin composition, and the flame-retardant resin composition each of which has a predetermined thickness onto an outer periphery of a tin-plated copper conductor wire having an outer diameter of 1.25 mm, and then, by cross-linkage of each component with such irradiation with electron beam as causing an absorbed dose of 75 kGy. In the produced insulated wire 1, the first flame-retardant layer having the thickness of 0.10 mm, the insulating layer having the thickness of 0.11 mm, and the second flame-retardant layer having the thickness of 0.29 mm were formed in this order from the conductor side. The thickness of the coating layer was 0.50 mm. The ratio of the thickness of the insulating layer was 22.0%.

Note that the ratio of the thickness of the insulating layer was calculated by using the following formula.

"Ratio of Thickness of Insulating Layer"="Thickness of Insulating Layer"/"Thickness of Coating Layer"×100(%)

The produced insulated wire 1 was evaluated in the mechanical strength, the direct-current stability, and the flame-retardant property under the following method.

<Characteristic Evaluation>

(Mechanical Strength)

For the mechanical strength, the breaking elongation under the tensile test was evaluated on the basis of EN50264, 60811-1-2. Specifically, the tensile test with a tension rate of 200 m/min was executed to a cylindrical sample that was obtained by pulling out the conductor from the insulated wire. When the breaking elongation was equal to or larger than 150%, its result was evaluated as "○". When the breaking elongation was smaller than 150%, its result was evaluated as "X".

(Direct-Current Stability)

The direct-current stability was evaluated under the direct-current stability test in conformity to EN50305.6.7. Specifically, after the insulated wire 1 was immersed in a 3% NaCl aqueous solution at 85° C. and applied with a voltage of 1500 V, when the electrical breakdown did not occur even after the elapse of 240 hours or longer, its result was evaluated as "pass (○)" indicating excellent electrical characteristics. When the electrical breakdown occurred within less than the elapse of 240 hours, its result was evaluated as "fail (X)".

(Flame-Retardant Property)

For the flame-retardant property, the vertical tray flame test (VTFT) was executed on the basis of EN50266-2-4. Specifically, seven electrical wires each having an entire length of 3.5 m were stranded to produce one bunch stranded wire, eleven bunch wires were vertically arranged with equal intervals and were burned for 20 minutes, and then, were self-extinguished. Then, its char length was targeted to be equal to or shorter than 2.5 m from the lower end. When the char length was equal to or shorter than 2.5 m, its result was evaluated as "pass (○)". When the char length was longer than 2.5 m, its result was evaluated as "fail (X)".

As each thickness of the first flame-retardant layer, the insulating layer, and the second flame-retardant layer, an average obtained by separating a sample having a length of 1 m into 10 segments and observing and measuring each cross section of these segments by using a microscope was employed.

The three-layer co-extrusion was executed by using three single-screw extruders and combining the resin compositions in a crosshead.

(Diameter Reduction)

In comparison with data of Conductor diameter and Mean thickness of insulation shown in "Table 1"—"General data"—"Cable type 0.6/1 kV unsheathed" in EN50264-3-1 (2008), when the thickness of the coating layer was larger than the outer diameter of the conductor, its result was evaluated as "fail (X)". When the thickness of the coating layer was smaller than the outer diameter of the conductor, its result was evaluated as "pass (○)".

Second Practical Example

In a second practical example, the insulated wire was produced as similar to that of the first practical example except for change in the ratio of the thickness of the insulating layer by changes in the thicknesses of the insulating layer and the second flame-retardant layer. Specifically, in the produced insulated wire 1, the first flame-retardant layer having the thickness of 0.10 mm, the insulated layer having the thickness of 0.06 mm, and the second flame-retardant layer having the thickness of 0.34 mm were formed in this order from the conductor side. The thickness of the coating layer was 0.50 mm. The ratio of the thickness of the insulating layer was 12.0%.

Third Practical Example

In a third practical example, the insulated wire was produced as similar to that of the first practical example except for change in the ratio of the thickness of the insulating layer by changes in the thickness of the insulating layer and the second flame-retardant layer. Specifically, in the produced insulated wire 1, the first flame-retardant layer having the thickness of 0.10 mm, the insulated layer having the thickness of 0.16 mm, and the second flame-retardant layer having the thickness of 0.24 mm were formed in this order from the conductor side. The thickness of the coating layer was 0.50 mm. The ratio of the thickness of the insulating layer was 32.0%. Results of the above-described first to third practical examples are shown in a table 1.

TABLE 1

| | | First practical example | Second practical example | Third practical example |
|---|---|---|---|---|
| First flame-retardant layer | Thickness (mm) | 0.10 | 0.10 | 0.10 |
| Insulating layer | Thickness (mm) | 0.11 | 0.06 | 0.16 |
| Second flame-retardant layer | Thickness (mm) | 0.29 | 0.34 | 0.24 |
| Coating layer | Thickness (mm) | 0.50 | 0.50 | 0.50 |
| Ratio of thickness of insulating layer | % | 22.0 | 12.0 | 32.0 |
| Characteristic evaluation result | Mechanical strength | ○ | ○ | ○ |
| | Direct-current stability | ○ | ○ | ○ |
| | Flame-retardant property | ○ | ○ | ○ |
| | Diameter reduction | ○ | ○ | ○ |

First to Third Practical Examples

The first to third practical examples passed (○) in the mechanical strength, the direct-current stability, the flame retardant property and the diameter reduction.

First Comparative Example

An insulated wire with the insulating layer and the second flame-retardant layer having the thicknesses shown in a table 2 were produced without using the first flame-retardant layer.

It was confirmed that the first comparative example passed (○) in the mechanical strength, the direct-current stability, and the flame-retardant property. However, while the outer diameter of the conductor was 1.25 mm and the thickness of the coating layer was 0.70 mm in the first comparative example, the outer diameter of the conductor is 1.25 mm and the thickness of the coating layer is 0.6 mm in Table 1 of EN50264-3-1 described above. Therefore, in comparison between both thicknesses of the coating layers, the first comparative example failed (X) in the diameter reduction because the thickness of the coating layer was larger than the outer diameter of the conductor.

Second Comparative Example

In a second comparative example, the insulated wire was produced as similar to that of the first practical example except for change in the ratio of the thickness of the insulating layer by changes in the thicknesses of the insulating layer and the second flame-retardant layer, and the ratio of the thickness of the insulating layer was 6.0%. The second comparative example failed (X) in the direct-current stability and the mechanical strength because the ratio of the thickness of the insulating layer was lower than a determined range of the present invention.

Third Comparative Example

In a third comparative example, the insulated wire as similar to that of the first example except for change in the ratio of the thickness of the insulating layer due to changes in the thicknesses of the insulating layer and the second flame-retardant layer was produced, and the ratio of the thickness of the insulating layer was 38.0%. The third comparative example failed (X) in the flame-retardant property because the ratio of the thickness of the insulating layer was lower than a determined range of the present invention.

Results of the above-described first to third comparative examples are shown in a table 2.

TABLE 2

| | | First comparative example | Second comparative example | Third comparative example |
|---|---|---|---|---|
| First flame-retardant layer | Thickness (mm) | — | 0.10 | 0.10 |
| Insulating layer | Thickness (mm) | 0.30 | 0.03 | 0.19 |
| Second flame-retardant layer | Thickness (mm) | 0.40 | 0.37 | 0.21 |
| Coating layer | Thickness (mm) | 0.70 | 0.50 | 0.50 |
| Ratio of thickness of insulating layer | % | 42.8 | 6.0 | 38.0 |
| Characteristic evaluation result | Mechanical strength | ○ | X | ○ |
| | Direct-current stability | ○ | ○ | ○ |
| | Flame-retardant Property | ○ | X | X |
| | Diameter reduction | X | ○ | ○ |

What is claimed is:

1. An insulated wire comprising:

a conductor; and a coating layer arranged on an outer periphery of the conductor, wherein the coating layer includes:

a plurality of flame-retardant layers each made of a flame-retardant resin composition; and an insulating layer interposed between the plurality of flame-retardant layers, wherein the plurality of flame-retardant layers includes:

a first flame-retardant layer formed on the outer periphery of the conductor, and a second flame-retardant layer that is an outermost layer of the plurality of flame-retardant layers, wherein a resin component of the second flame-retardant-layer has polyolefin, and wherein a ratio of a thickness of the insulating layer to a thickness of the coating layer is equal to or larger than 10% and equal to or smaller than 35%.

2. The insulated wire according to claim 1, wherein the insulated wire has a flame-retardant property that allows the insulated wire to pass a vertical tray flame test (VTFT) on the basis of EN 50266-2-4.

3. The insulated wire according to claim 1, wherein the insulated wire has a direct-current stability that allows the insulated wire to pass a direct-current stability test in conformity to EN 50305.6.7.

4. The insulated wire according to claim 1, wherein, in the insulated wire, a diameter of the conductor is equal to or smaller than 1.25 mm, and a thickness of the coating layer is smaller than 0.6 mm.

5. The insulated wire according to claim 1, wherein breaking elongation of the coating layer measured in a tensile test with a tension rate of 200 m/min is equal to or larger than 150%.

6. The insulated wire according to claim 1, wherein an oxygen index of the flame-retardant layer defined by JIS K7201-2 is higher than 45.

7. The insulated wire according to claim 1, wherein a volume resistivity of the insulating layer defined by JIS C2151 is higher than $5.0\times10^{15}$ (Ωcm).

8. The insulated wire according to claim 1, wherein a flame-retardant resin composition making up the flame-retardant layer includes at least one resin selected from a group consisting of high-density polyethylene, linear low-density polyethylene, low-density polyethylene, ethylene-(α-olefin) copolymer, ethylene-vinyl acetate copolymer, ethylene-acrylic acid ester copolymer, and ethylene -propylene-diene copolymer.

9. The insulated wire according to claim 1, wherein a flame-retardant resin composition making up the flame-retardant layer contains a resin component and a flame retardant so that 150 or more and 250 or less parts by mass of the flame retardant per 100 parts by mass of the resin component is contained.

10. The insulated wire according to claim 1, wherein a resin composition making up the insulating layer contains a resin component so that the resin component is made of high-density polyethylene and/or low -density polyethylene.

11. The insulated wire according to claim 1, wherein the insulating layer is made of a cross-linked substance so that a gel fraction of the cross-linked substance is equal to or larger than 40% and equal to or smaller than 100%.

12. The insulated wire according to claim 1, wherein a resin composition making up the insulating layer contains a resin component and an additive so that 5 or less parts by mass of the additive per 100 parts by mass of the resin component.

* * * * *